United States Patent [19]

Beelart, Jr.

[11] Patent Number: 4,835,799

[45] Date of Patent: Jun. 6, 1989

[54] APPARATUS FOR MANIPULATING A HINGED MEMBER

[76] Inventor: Joseph H. Beelart, Jr., 103 Quarry Rd., #108, Point Richmond, Calif. 94801

[21] Appl. No.: 58,450

[22] Filed: Jun. 5, 1987

[51] Int. Cl.[4] ..... A47K 13/10; B25J 1/00

[52] U.S. Cl. ..... 4/661; 4/251; 294/13

[58] Field of Search ..... 4/661, 251, 308, 237; 294/12, 13, 27 R, 27 H, 28, 29, 31 R; 16/124, 121, 114; 81/300, 305, 306, 347, 351, 126, 127

[56] References Cited

U.S. PATENT DOCUMENTS

| | | | |
|---|---|---|---|
| 75,427 | 3/1868 | Hyslop | 294/3 |
| 313,571 | 3/1885 | Bauer | 81/300 |
| 946,568 | 1/1910 | Stong | 294/29 |
| 1,396,140 | 11/1921 | Nelson | 294/13 X |
| 2,210,904 | 8/1940 | Durant | 294/15 |
| 2,692,394 | 10/1954 | Paulus | 4/251 |
| 3,269,765 | 8/1966 | Pryce | 294/31.1 |
| 3,342,517 | 9/1967 | Pryce | 294/27.1 |
| 3,717,884 | 2/1973 | Mantooth | 4/251 X |
| 4,048,456 | 4/1978 | Pasbrig | 81/127 X |
| 4,522,088 | 6/1985 | Berglund | 294/15 |
| 4,647,094 | 3/1987 | Bergkvist et al. | 294/3 |

*Primary Examiner*—Donald Watkins

*Attorney, Agent, or Firm*—Townsend and Townsend

[57] ABSTRACT

A portable apparatus for manipulating a hinged member, comprising a telescoping handle and a jaw having upper and lower jaw members pivotally connected to one end of the handle. The upper and lower jaw members are oriented parallel to each other and are spaced apart for receiving the hinged member therebetween. The inner surfaces of the upper and lower jaw members are shaped for conforming to the shape of the hinged member. First and second resilient members are connected to the upper and lower jaw members, respectively, and to the handle for biasing the jaw member toward a position wherein the jaw is aligned with an axis of the handle. The biasing action of the resilient members provides a clamping action to prevent the hinged member from being dislodged from the jaws and also provides a torque in both a clockwise and counterclockwise direction, depending on the orientation of the hinged member, for facilitating the initiation of the raising or lowering operation.

19 Claims, 2 Drawing Sheets

APPARATUS FOR MANIPULATING A HINGED MEMBER

BACKGROUND OF THE INVENTION

1. Field Of The Invention

The present invention relates to an apparatus for manipulating a hinged member and more particularly, to an apparatus for manipulating a hinged toilet seat or lid.

2. Description Of The Relevant Art

Some people have an aversion to handling toilet seats and lids, due to a buildup of human waste, fungus growth, or possible bacterial and viral contamination, however slight. Other persons may find it difficult to manipulate a toilet seat or lid due to physical disabilities. For example, some people may find it difficult to bend over to reach for the seat or lid, or they may find it difficult to manipulate the lid from a horizontal to a vertical orientation, and vice versa, because of the substantial wrist and arm movements required.

Known devices for facilitating the manipulation of a hinged member, such as a toilet seat, comprise a handle affixed to the hinged member, as exemplified in U.S. Pat. Nos. 1,999,555; 2,758,315; 3,191,193; 3,717,884; 3,935,601; and 4,129,907. Although these devices do provide a grasping mechanism for the hinged member, the affixed nature of the devices makes cleaning more difficult, and hence the device is likely to be as contaminated as the hinged member. Furthermore, the projecting handle disclosed in the foregoing patents may interfere with a person's comfort when he or she is sitting on the seat and each device requires the user to bend over for manipulating the seat from the horizontal to vertical position.

Another device for manipulating a hinged member is exemplified by U.S. Pat. No. 4,578,830, which discloses a permanently affixed lever which is pivoted to open a toilet seat. As with other conventional devices, the affixed nature of the device and, in this case, a complicated gearing mechanism, makes cleaning more difficult and users still must bend over to activate the device.

Finally, the fact that conventional devices are affixed to the hinged member means that the devices are not always provided when the user wants them. This is especially true with public toilets, which ordinarily do not provide such lifting devices and frequently lack proper maintenance.

SUMMARY OF THE INVENTION

The present invention is a portable apparatus for manipulating a hinged member. In one embodiment of the present invention directed to an apparatus for manipulating a hinged toilet seat or lid, a jaw comprising upper and lower jaw members is connected pivotally to one end of a handle. The handle may have a telescopic construction to accommodate the different distances between the user and the hinged member. The upper and lower jaw members are oriented parallel to each other and are spaced apart for receiving the hinged member therebetween. The inner surfaces of the upper and lower jaw members are shaped for conforming to the shape of the hinged member. For use with a toilet seat, the inner surface of the upper jaw member has a concave shape, and the inner surface of the lower member is substantially flat.

First and second resilient members, e.g., springs, are connected to the upper and lower jaw members, respectively, and to the handle for biasing the jaw member toward a position wherein the jaw is aligned with an axis of the handle. The biasing action of the springs minimizes the lifting strength required to operate the device and provides a clockwise and counterclockwise torque, depending upon the orientation of the hinged member for facilitating the initiation of the lowering or raising operation. The biasing action of the springs also provides a clamping action to prevent the hinged member from falling out of the jaws.

The economic and simple design of the present invention makes it easy to clean and store, and the portable nature of the device means that it is readily available when needed and does not cause discomfort when the user is seated on the toilet. Use of the device requires no bending over and requires an absolute minimum of lifting strength, with very little arm and wrist movement.

DETAILED DESCRIPTION OF THE PREFERRED EMBODIMENTS

Figure 1:
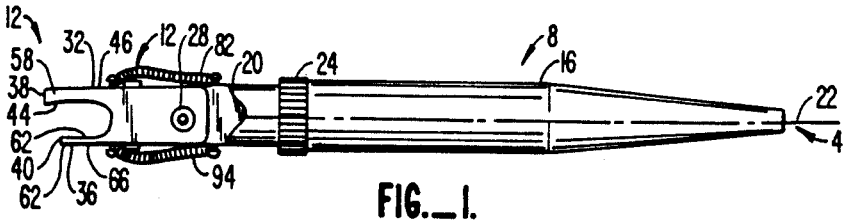
FIG. 1 is a side view of an apparatus for manipulating a hinged member according to the present invention.
Figure 2:
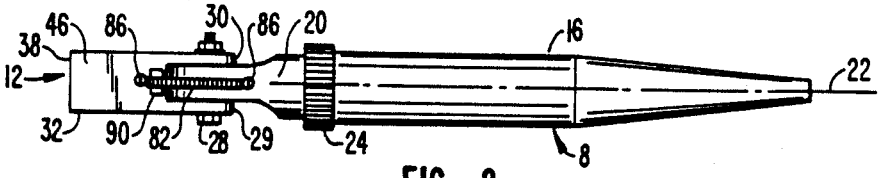
FIG. 2 is a top view of the apparatus according to the present invention.
Figure 3:
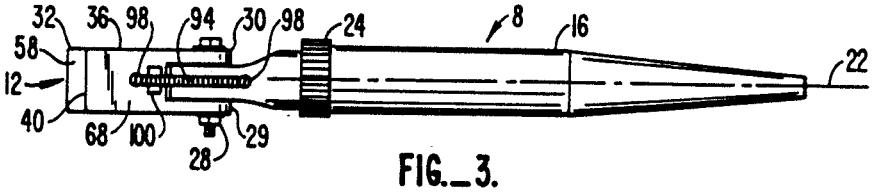
FIG. 3 is a bottom view of the apparatus according to the present invention.
Figure 4:
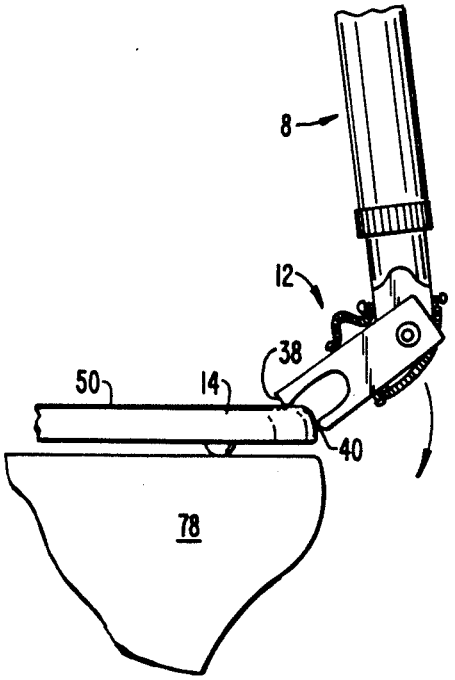
FIG. 4 is a view of the apparatus according to the present invention being placed in a position of use.

FIGS. 1–3 are side, top and bottom views, respectively, of an apparatus 4 comprising a handle 8 and a jaw 12 for manipulating a hinged member. e.g., a toilet seat 14 (FIG. 4). Handle 8 comprises an outer handle member 16 and an inner handle member 20 slidingly disposed within outer handle member 16 for telescopically extending the length of handle 8 along an axis 22. Once the desired length of handle 8 is determined, the relative positions of outer handle member 16 and inner handle member 20 are fixed in a well known manner by a lock nut 24.

Jaw 12 is connected pivotally to one end of handle 8 preferably to inner handle member 20, by a pin 28 extending through collars 29 and 30. Jaw 12 comprises an upper jaw member 32 and a lower jaw member 36 extending from handle 8 and terminating in free ends 38 and 40, respectively. Upper and lower jaw members 32 and 36 are oriented generally parallel to each other and are spaced apart from each other for receiving a hinged member, such as toilet seat 14, therebetween.

Figure 5:
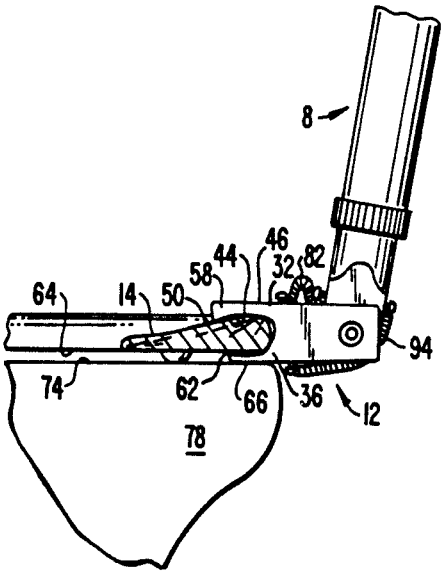
FIG. 5 is a view of the apparatus according to the present invention in a seat-down position.
Figure 7:
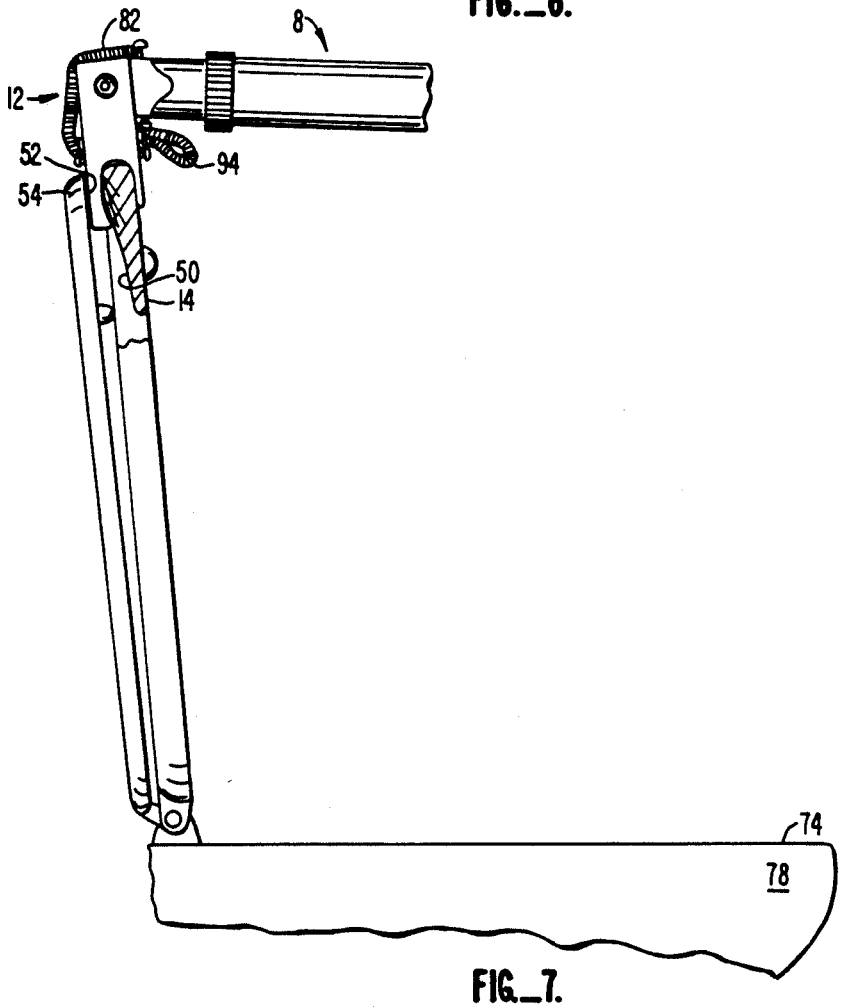
FIG. 7 is a view of the apparatus according to the present invention in a seat-up position.

Upper jaw member 32 has a concave inner surface 44 for conforming to the shape of an upper surface 50 of the toilet seat 14, although the shape of inner surface 44 may vary according to the shape of the hinged member with which the device is used. The outer surface 46 of upper jaw member 32 preferably is flat, and upper jaw member 32 preferably is sized so that it may fit between the upper surface 50 of seat 14 and a lower surface 52 of a lid 54, as shown in FIG. 7. Upper jaw member 32 also has a lip 58 extending toward an interior section of jaw 12 for aiding the clamping action of jaw 12 when the device is in use. Similarly, lower jaw member 36 has a substantially flat inner surface 62 shaped to conform to the shape of a lower surface 64 of toilet seat 14 as shown in FIG. 5. The outer surface 66 of lower jaw member 36 also is substantially flat and is sized to fit between lower surface 64 of seat 14 and an upper surface 74 of a toilet bowl 78. Lower jaw member 36 is shorter than upper jaw member 32 for reasons discussed below.

To facilitate the lamping action of jaw 12, a first spring 82 is connected by screws 86 to the outer surface 46 of upper jaw member 32 and to inner handle member 20, as shown in FIG. 2. For bending, and hence breaking the tension of, spring 82 when jaw 12 is aligned with the axis 22 of handle 8, a spacer 90 preferably is disposed between spring 82 and upper jaw member 32. A similar spring 94 is connected by screws 98 to outer surface 66 of lower jaw member 36 and to inner handle 20, as shown in FIG. 3. A spacer 100 is disposed between spring 94 and lower jaw member 36 for bending, and hence breaking the tension of, spring 94. Spacers 90 and 100 break the tension of springs 82 and 94, respectively, so that a minimum amount of force is required to initiate pivoting of jaw 12 away from axis 22.

Figure 6:
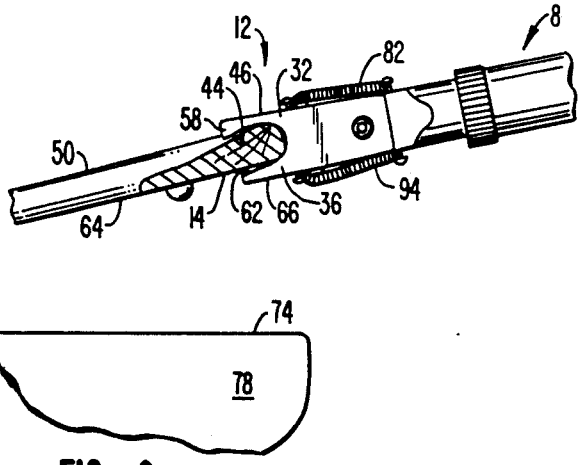
FIG. 6 is a view of the apparatus according to the present invention in a seat-raising position.

Operation of the present invention may be understood by referring to FIGS. 4–7. As shown in FIG. 4, apparatus 4 is mounted to seat 14 by placing free ends 38 and 40 of jaw 12 against the upper surface of seat 14 and by pushing down on handle 8 so that jaw 12 pivots clockwise and moves into the position shown in FIG. 5. The shorter lower jaw member 36 facilitates this action. When so positioned, spring 94 exerts tension on jaw 12 in a counterclockwise direction. This counterclockwise tension provides a clamping action to maintain jaw 12 affixed to seat 14 and also provides a torque helping to pivot seat 14 into the open position. As a result, very little wrist movement is required by the operator to lift the seat. Seat 14 then is lifted, as shown in FIG. 6, until it is vertically upright and adjacent to lid 54, as shown in FIG. 7. As the seat progresses from the position shown in FIG. 6 to that shown in FIG. 7, spring 82 provides tension to jaw 12 in a clockwise direction for enhancing the clamping action of jaw 12. The clockwise torque is particularly useful when the seat is to be lowered, since it helps to pivot seat 14 into the lower position. Accordingly, the device according to the present invention provides clamping and a corresponding torque action in both the horizontal and vertical orientations of the toilet seat. This minimizes the amount of wrist and arm motion required to lift and lower the lid.

While the above is a complete description of a preferred embodiment of the present invention, various modifications are obvious to those skilled in the art. For example, handle 8 and/or jaw 12 may be formed as one piece, and they may be formed from wood, plastic, and other materials. Springs 82 and 94 may be replaced by rubber or some other elastic material to provide biasing of jaw 12 and, if so, spacers 90 and 100 may be omitted. Consequently, the description should not be used to limit the scope of the invention which is properly described in the claims.

I claim:

1. An apparatus for manipulating a free end of a hinged member comprising:

a handle;

a jaw having first and second jaw members spaced apart for receiving the free end of the hinged member therebetween; and jaw connecting means for pivotally connecting both the first and second jaw members to an end of the handle so that the first and second jaw members pivot simultaneously relative to the handle.

2. The apparatus according to claim I wherein the jaw connecting means includes jaw member connecting means for rigidly connecting the first and second jaw members to each other at one end.

3. The apparatus according to claim 1 wherein the first and second jaw members extend generally parallel to each other, each jaw member terminating in a free end.

4. The apparatus according to claim 2 wherein the second jaw member is shorter than the first jaw member.

5. The apparatus according to claim 4 wherein an inner surface of the first jaw member has a concave shape.

6. The apparatus according to claim 5 wherein an inner surface of the second jaw member is substantially flat.

7. The apparatus according to claim 6 wherein the free end of the first jaw member has a portion projecting toward an interior section of the jaw.

8. The apparatus according to claim 1 further comprising biasing means, connected to the jaw, for biasing the jaw toward a prescribed orientation.

9. The apparatus according to claim 8 wherein the biasing means comprises a first resilient member connected to the first jaw member and to the handle for biasing the jaw toward a handle axis when the jaw pivots in the direction of the second jaw member.

10. The apparatus according to claim 9 wherein the biasing means further comprises a second resilient member connected to the second jaw member and to the handle for biasing the jaw toward the handle axis when the jaw pivots in the direction of the first jaw member.

11. The apparatus according to claim 10 wherein in the handle includes means for telescopically extending the handle.

12. The apparatus according to claim 7 wherein an outer surface of the first jaw member is substantially flat.

13. The apparatus according to claim 12 wherein an outer surface of the second jaw member is substantially flat.

14. An apparatus for manipulating a hinged toilet seat or lid comprising:

an elongated handle having an axis;

a jaw pivotally connected to an end of the handle, the jaw comprising:

an upper jaw member extending from the end of the handle and terminating in a free end, the upper jaw member having a substantially flat outer surface, a concave inner surface, and a lip at the free end; and a lower jaw member extending from the end of the handle and terminating in a free end, the lower jaw member being shorter than and spaced apart from the upper jaw member, and the lower jaw member having a substantially flat inner and outer surfaces;

wherein the upper and lower jaw members are rigidly affixed to each other at a location in close proximity to the end of the handle so that both the upper and lower jaw members pivot simultaneously relative to the handle.

15. The apparatus according to claim 14 wherein the lower jaw member is sized to fit between a lower surface of a toilet seat and an upper surface of a toilet bowl.

16. The apparatus according to claim 15 wherein the upper jaw member is sized to fit between an upper surface of the toilet seat and a lower surface of a toilet lid.

17. The apparatus according to claim 16 further comprising:

a first spring connected to the handle and to the outer surface of the upper jaw member for biasing the jaw toward a handle axis when the jaw pivots in the direction of the lower jaw member; and a second spring connected to the handle and to the outer surface of the lower jaw member for biasing the jaw toward the handle axis when the jaw pivots in the direction of the upper jaw member.

18. The apparatus according to claim 17 further comprising:

a first spacer disposed between the first spring and the upper jaw member for bending the first spring when the jaw is aligned with the axis of the handle; and a second spacer disposed between the second spring and the lower jaw member for bending the second spring when the jaw is aligned with the axis of the handle.

19. The apparatus according to claim 16 wherein the handle includes means for telescopically extending the handle along the axis.

* * * * *